US010207506B2

(12) United States Patent
Iwasaki et al.

(10) Patent No.: US 10,207,506 B2
(45) Date of Patent: Feb. 19, 2019

(54) INKJET PRINTING APPARATUS AND RECOVERY METHOD OF PRINT HEAD

(71) Applicant: CANON KABUSHIKI KAISHA, Tokyo (JP)

(72) Inventors: Osamu Iwasaki, Tokyo (JP); Tomoyuki Tenkawa, Yokohama (JP); Atsushi Takahashi, Tama (JP); Kei Kosaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 14/828,981

(22) Filed: Aug. 18, 2015

(65) Prior Publication Data

US 2016/0052278 A1 Feb. 25, 2016

(30) Foreign Application Priority Data

Aug. 25, 2014 (JP) ..... 2014-170345

(51) Int. Cl.
*B41J 2/165* (2006.01)

(52) U.S. Cl.
CPC ..... *B41J 2/16532* (2013.01); *B41J 2/16508* (2013.01)

(58) Field of Classification Search
CPC ..... B41J 2/16532; B41J 2/16508; B41J 2/16523; B41J 2/1652; B41J 2/165; B41J 2/16573; B41J 2002/16573
See application file for complete search history.

(56) References Cited

U.S. PATENT DOCUMENTS 4,967,204 A * 10/1990 Terasawa ..... B41J 2/1652 347/23
6,042,214 A 3/2000 Minowa et al.
6,176,564 B1 * 1/2001 Katayama ..... B41J 2/16532 347/23
6,994,416 B2 * 2/2006 Seki ..... B41J 2/16511 347/19
7,011,386 B2 * 3/2006 Iwasaki ..... B41J 2/16526 347/14
7,144,096 B2 12/2006 Seki et al.
8,672,446 B2 * 3/2014 Noda ..... B41J 29/38 347/30

(Continued)

FOREIGN PATENT DOCUMENTS

CN 1172015 A 2/1998
CN 1488504 A 4/2004

(Continued)

OTHER PUBLICATIONS

Machine translation of JP 2000085150A.*

(Continued)

*Primary Examiner* — Julian D Huffman
*Assistant Examiner* — Michael Konczal
(74) *Attorney, Agent, or Firm* — Venable LLP

(57) ABSTRACT

There is provided an inkjet printing apparatus that can execute a recovery process appropriate for a print head according to a use condition of the inkjet printing apparatus. Therefore a recovery operation is performed based upon both an elapsed time in a non-use state where the printing is not performed and an elapsed time from the previous recovery process.

6 Claims, 9 Drawing Sheets

(56) References Cited

U.S. PATENT DOCUMENTS

| | | | | |
|---|---|---|---|---|
| 8,801,143 | B2 * | 8/2014 | Yamashiro | B41J 2/16517 347/19 |
| 2007/0046721 | A1 | 3/2007 | Miyazawa | |
| 2012/0139990 | A1 | 6/2012 | Walker et al. | |

FOREIGN PATENT DOCUMENTS

| | | | | |
|---|---|---|---|---|
| JP | H2-92548 | A | | 4/1990 |
| JP | H6-166184 | A | | 6/1994 |
| JP | 2000085150 | A | * | 3/2000 |
| JP | 2000-118004 | A | | 4/2000 |
| JP | 2000289229 | A | | 10/2000 |
| JP | 2001180005 | A | | 7/2001 |
| JP | 2002029068 | A | | 1/2002 |
| JP | 2002292904 | A | | 10/2002 |
| JP | 2002316426 | A | | 10/2002 |
| JP | 2004-268539 | A | | 9/2004 |
| JP | 2007083706 | A | | 4/2007 |
| JP | 2007-245619 | A | | 9/2007 |
| JP | 2008062450 | A | | 3/2008 |
| JP | 2010-064342 | A | | 3/2010 |

OTHER PUBLICATIONS

Tomoyuki Tenkawa Atsushi Takahashi Kei Kosaka, U.S. Appl. No. 14/815,151, filed Jul. 31, 2015.

Kei Takarabe Akiyoshi Sahara Toshiyuki Kuroda Atsushi Takahashi Kei Kosaka Tomoyuki Tenkawa, U.S. Appl. No. 14/829,000, filed Aug. 18, 2015.

Office Action in Chinese Patent Application No. 201510527329.8, dated Aug. 3, 2016.

Japanese Office Action issued in corresponding Japanese Application No. 2014170345 dated May 22, 2018.

* cited by examiner

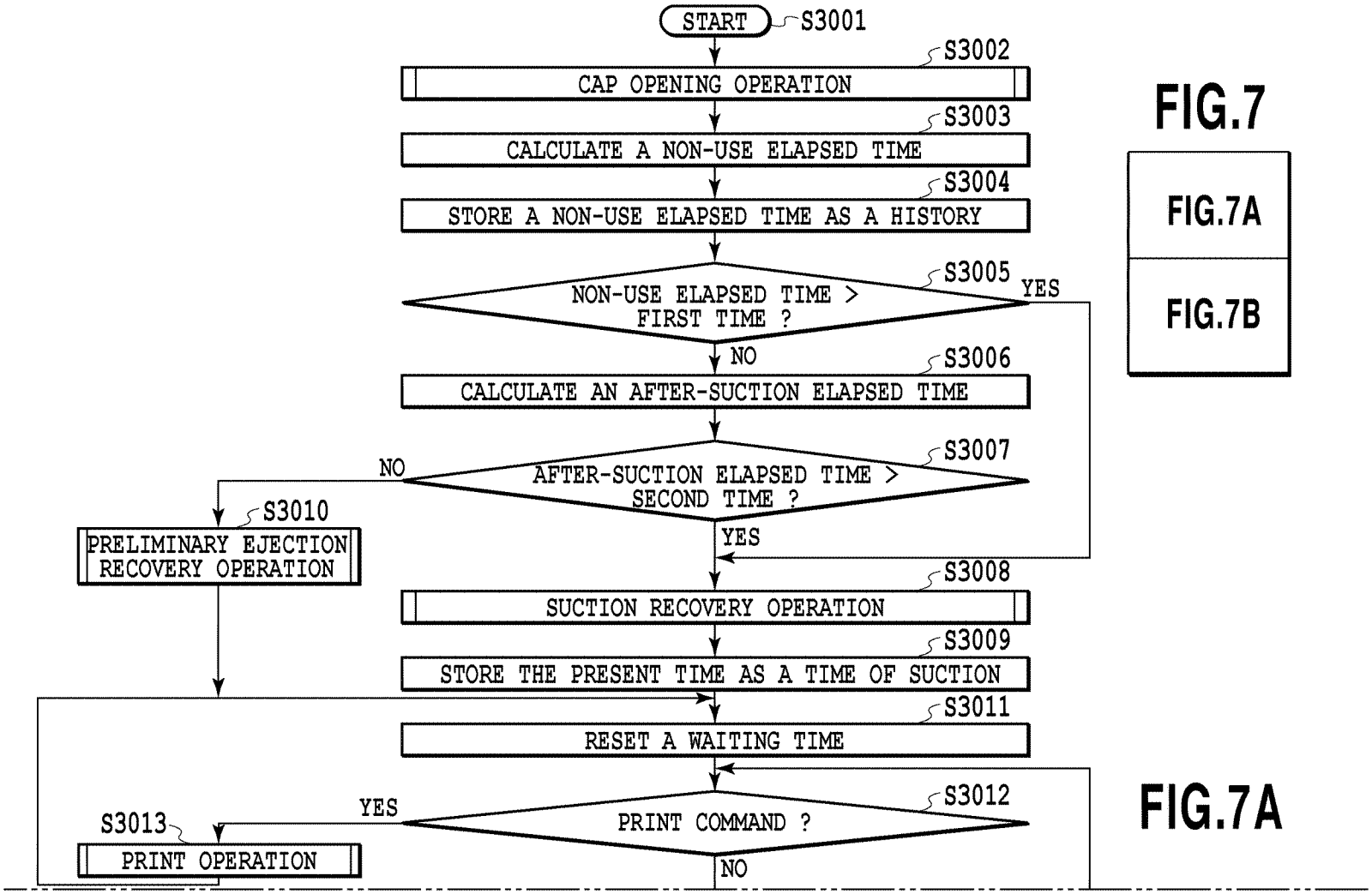
FIG.7
FIG.7A
FIG.7B
FIG.7A
START
S3001
CAP OPENING OPERATION
S3002
CALCULATE A NON-USE ELAPSED TIME
S3003
STORE A NON-USE ELAPSED TIME AS A HISTORY
S3004
NON-USE ELAPSED TIME > FIRST TIME ?
S3005
YES
NO
CALCULATE AN AFTER-SUCTION ELAPSED TIME
S3006
AFTER-SUCTION ELAPSED TIME > SECOND TIME ?
S3007
YES
NO
SUCTION RECOVERY OPERATION
S3008
STORE THE PRESENT TIME AS A TIME OF SUCTION
S3009
RESET A WAITING TIME
S3011
PRINT COMMAND ?
S3012
YES
NO
PRELIMINARY EJECTION RECOVERY OPERATION
S3010
PRINT OPERATION
S3013

INKJET PRINTING APPARATUS AND RECOVERY METHOD OF PRINT HEAD

BACKGROUND OF THE INVENTION

Field of the Invention

The present invention relates to an inkjet printing apparatus and a recovery method of a print head used in the inkjet printing apparatus.

Description of the Related Art

In an inkjet printing apparatus, ink supplied to a print head is injected on a print medium from ejection ports to print an image thereon. A cap is put on the ejection port of the print head, and a suction recovery process for performing suction through the cap is executed. This suction recovery process is executed for preventing or eliminating an ejection failure caused by ink thickened in viscosity, clogging of the ejection port due to adhesion of ink, air bubbles or foreign particles generated in a liquid passage communicated with the ejection port, and the like. At the time of starting with printing, this kind of suction recovery process is executed before the printing, and therefore the time required for completion of the printing becomes longer, resulting in making a user wait for the output.

On the other hand, Japanese Patent Laid-Open No. H02-092548 (1990) discloses a technology in which the suction recovery is executed according to an elapsed time from the previous printing. Therefore the recovery operation is performed only in a case where the suction aiming at removing the ink having adhered to the ejection port is necessary. That is, in a case where the printing is frequently performed, the suction recovery is not executed, and a user does not keep waiting for the output long.

In addition, Japanese Patent Laid-Open No. H06-166184 (1994) discloses a technology in which an elapsed time from the previous recovery process is calculated and a recovery process having a suction amount differing depending upon the elapsed time is executed. This technology thus prevents occurrence of the print failure even in a case where the apparatus is left in a non-use state for a long period of time while suppressing consumption of ink by suction at the recovery process.

However, in the sequence of the apparatus disclosed in Japanese Patent Laid-Open No. H02-092548 (1990), since the suction recovery is executed based upon the predetermined elapsed time from the previous printing, the suction is not executed in a case where the printing is frequently performed. In this process, the ink thickened in viscosity does not stay in the ejection port as long as the ejection continues to be performed, but air bubbles are possibly generated in the flow passage. Therefore in a case where the printing is frequently performed, the suction is not performed, and therefore it is not possible to prevent the ejection failure due to the air bubble mixed into the flow passage.

In addition, in the sequence of the apparatus disclosed in Japanese Patent Laid-Open No. H06-166184 (1994), the recovery process is executed based upon the elapsed time from the previous recovery process. Accordingly, in a case where a predetermined time elapses after the previous recovery process and the printing is frequently performed during the predetermined time, since the elapsed time from the previous printing is short, there is a little possibility that the adhesion of ink to the ejection port and the thicker viscosity of ink are generated. However, since the recovery process is executed according to a length of time from the previous recovery process, in some cases unnecessary recovery processes including a recovery operation for removing the ink having adhered to or thickened in viscosity in the ejection port are executed.

SUMMARY OF THE INVENTION

Therefore the present invention is made in order to resolve the aforementioned problems, and an object of the present invention is to provide an inkjet printing apparatus that can execute a recovery process appropriate for a print head according to a use condition of the inkjet printing apparatus.

Therefore an inkjet printing apparatus according to the present invention comprises a printing unit that ejects ink from an ejection port of a print head to perform a print operation;

- a sucking unit that presses a capon an ejection port face of the print head, the ejection port face being provided with the ejection port, to perform a sucking operation of sucking the ink from the ejection port of the print head;
- a non-use elapsed time obtaining unit that obtains a first elapsed time from a previous print operation by the printing unit;
- a control unit that, in a case where the first elapsed time obtained by the non-use elapsed time obtaining unit is longer than a first time, causes the sucking unit to perform the sucking operation; and
- an after-suction elapsed time obtaining unit that obtains a second elapsed time from a previous sucking operation by the sucking unit, wherein the control unit, in a case where the second elapsed time obtained by the after-suction elapsed time obtaining unit is longer than a second time longer than the first time, causes the sucking unit to perform the sucking operation.

According to the present invention, the inkjet printing apparatus can execute the appropriate recovery process of the print head according to the use condition.

Further features of the present invention will become apparent from the following description of exemplary embodiments (with reference to the attached drawings).

BRIEF DESCRIPTION OF THE DRAWINGS

FIG. 7 is a diagram showing the relationship between FIGS. 7A and 7B; and FIGS. 7A and 7B are a flow chart illustrating the process from a cap opening operation to a cap closing operation in the apparatus in FIG. 1.

DESCRIPTION OF THE EMBODIMENTS

First Embodiment

Hereinafter, a first embodiment according to the present invention will be in detail described with reference to the accompanying drawings.

(Structure of Apparatus Body)

Figure 1:
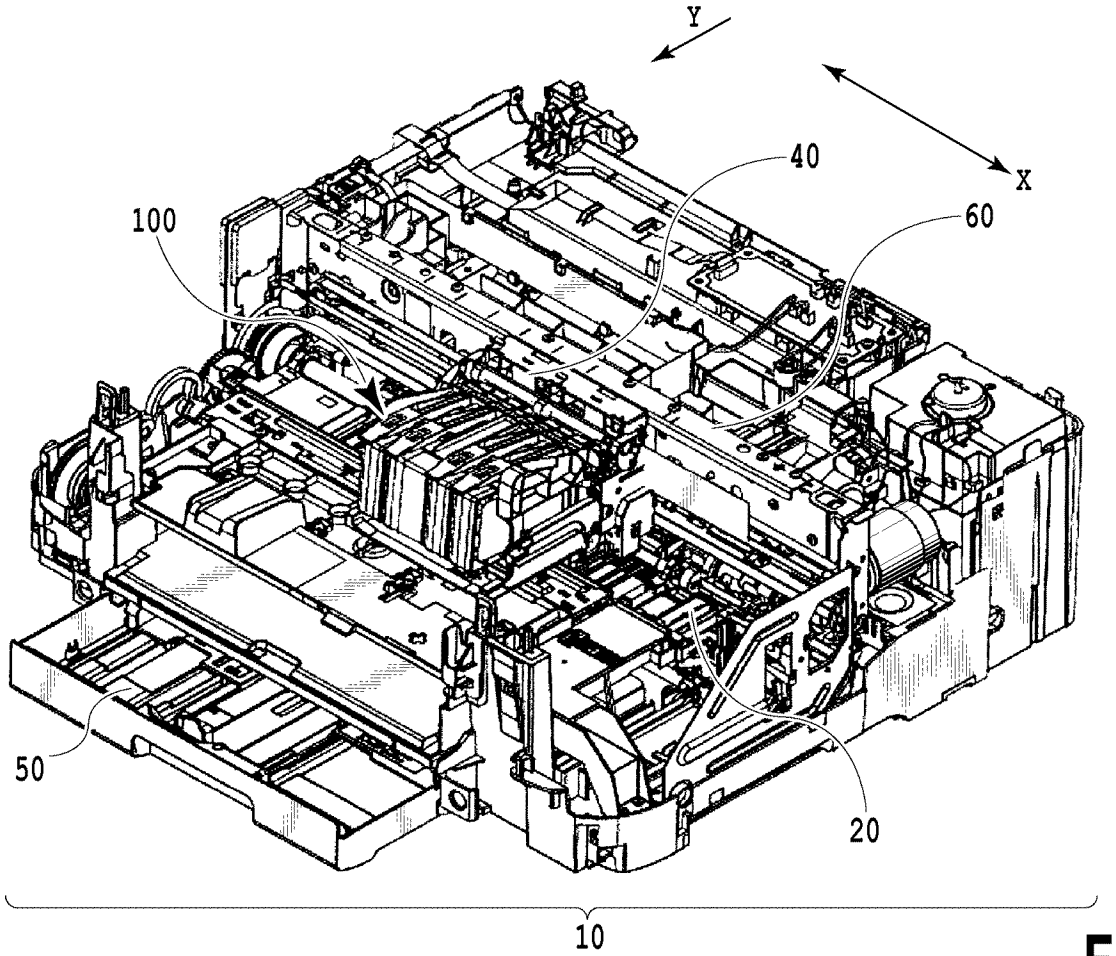
FIG. 1 is a perspective view diagram illustrating an internal structure of an inkjet printing apparatus according to the present invention.

FIG. 1 is a perspective view illustrating an internal structure of an inkjet printing apparatus 10 according to a first embodiment in the present invention. The inkjet printing apparatus 10 is schematically provided with a print head unit 100, a purge unit 20 that includes a pump unit for recovering ejection ports and ink supply flow passages in the print head unit 100, a carriage unit 40, and a sheet feeding device (not illustrated). In addition, a sheet feeding tray 50 is disposed on the bottom surface of the inkjet printing apparatus 10.

A print medium loaded on the sheet feeding tray 50 is conveyed by the sheet feeding device. A conveying direction (sub scan direction) of the print medium is illustrated in a direction of an arrow Y in FIG. 1. The print head unit 100 is loaded on the carriage unit 40 in the inkjet printing apparatus 10. The carriage unit 40 is movably supported in a main scan direction of an arrow X in FIG. 1 by a support rail 60 and the like.

(Structure of Purge Unit)

Figure 2:
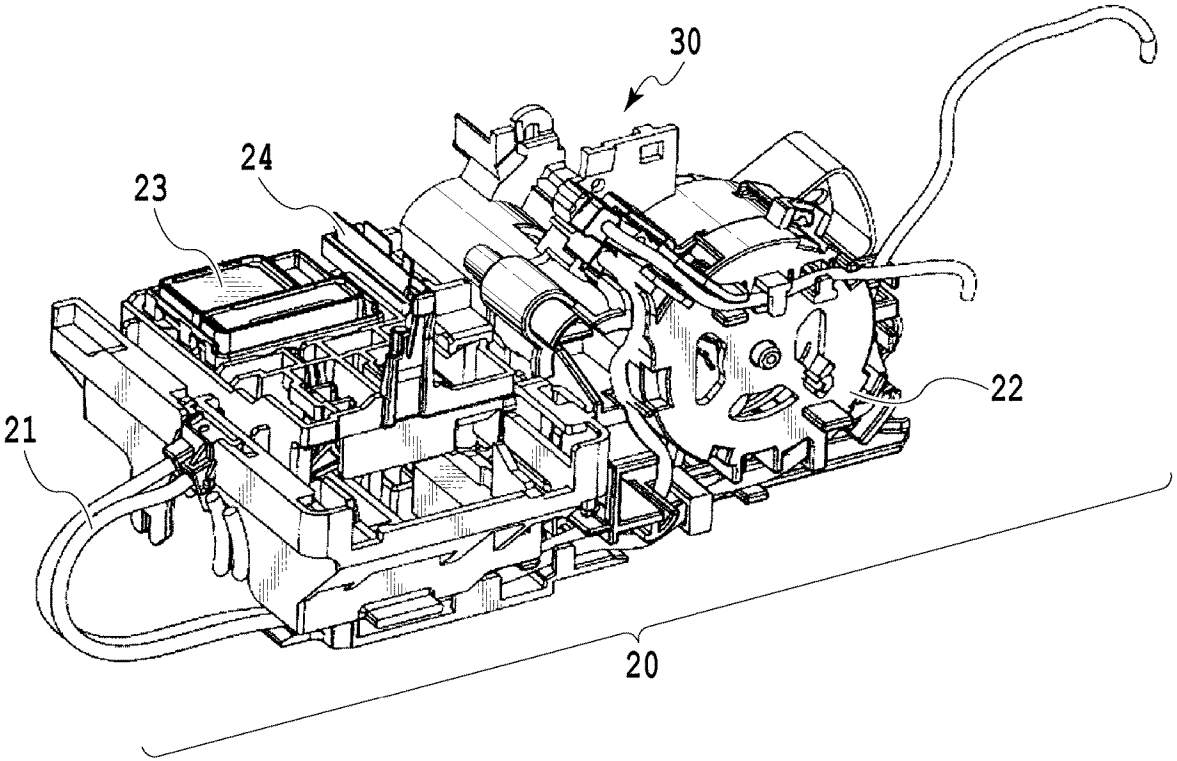
FIG. 2 is an essential part enlarged view illustrating a purge unit in FIG. 1.

FIG. 2 is an enlarged view illustrating the purge unit 20 in FIG. 1. The purge unit 20 is schematically provided with a tube 21, a motor (not illustrated), a tube pump 22 having a rotational body with a tube holding member, a cap 23, and a wiper blade 24. The cap 23 is provided to be able to abut (be pressed) on a face (ejection port face) provided with an ejection port line of each color in the print head unit 100, and is connected to the tube pump 22 that can introduce a negative pressure into the cap 23.

The negative pressure is generated in the cap 23 covering ejection ports by the tube pump 22 to suck and discharge air bubbles generated in the flow passage connected to the ejection port and the ink thickened in viscosity near the ejection port. With this configuration, it is possible to execute the recovery process for maintaining a proper ink ejection state of print heads 110. In addition, a preliminary ejection of the print head is performed into the cap 23. "Preliminary ejection" in the present specification means an operation of ejecting and discharging ink (ink not used in printing) from the print head other than the print operation to the print medium, and aims at discharging ink thickened in viscosity or in a mixed color.

(Structure of Print Head)

Figure 3A:
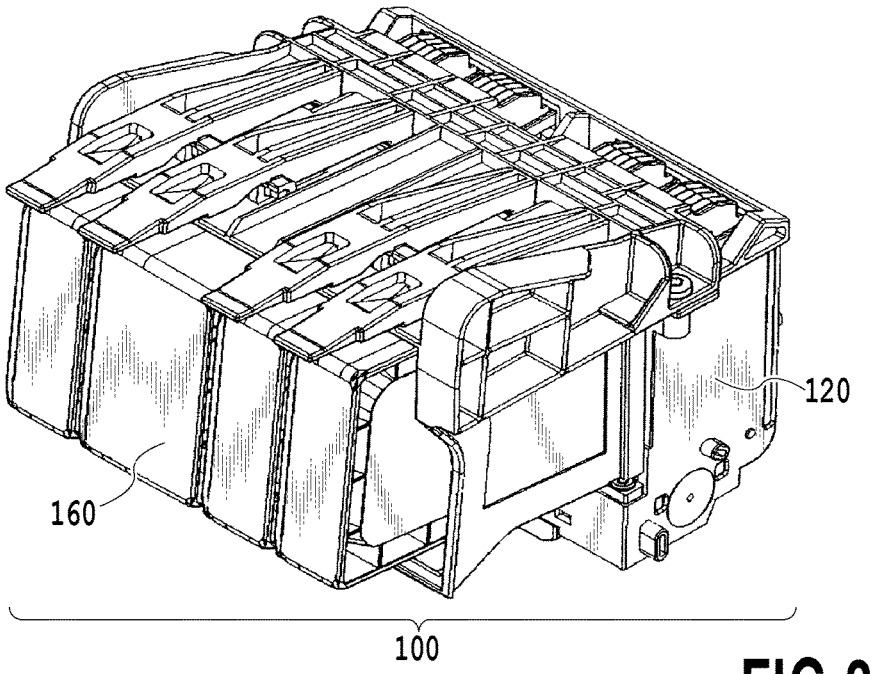
FIG. 3A is an enlarged view illustrating a print head unit in FIG. 1.
Figure 3B:
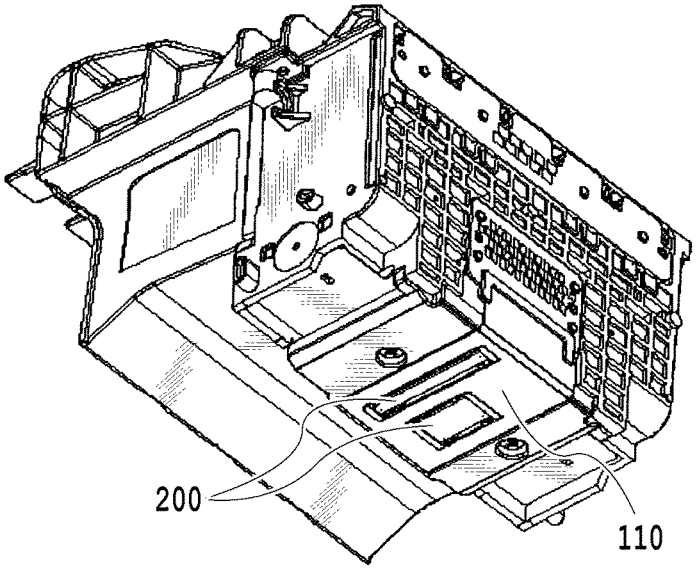
FIG. 3B is an enlarged view illustrating the print head unit in FIG. 1.

FIG. 3A and FIG. 3B are enlarged views illustrating the print head unit 100 in FIG. 1. The print head unit 100 has the print heads 110 that eject ink droplets on a print medium, and ink tanks 160 that independently supply pigment inks of four colors having yellow (Y), magenta (M), and cyan (C) and black (Bk). Each of the ink tanks 160 may be removable to the print head unit 100.

(Schematic Configuration of Control)

Figure 4:
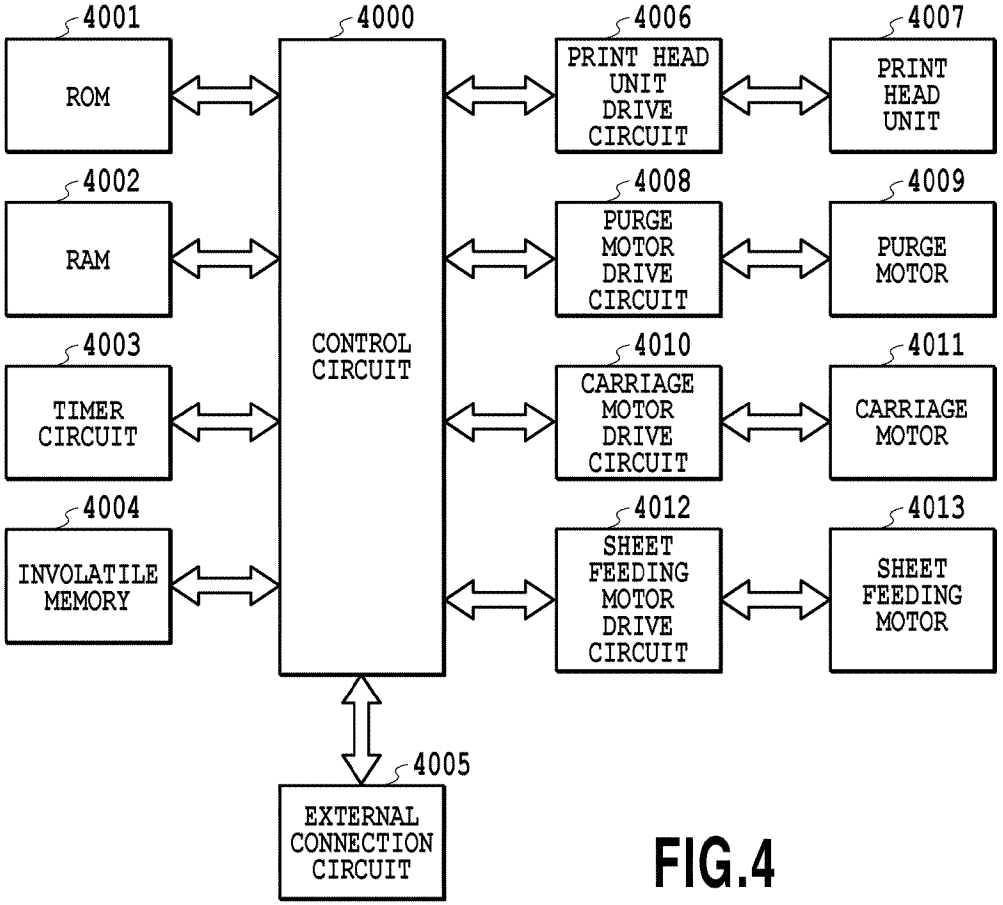
FIG. 4 is a block diagram illustrating the configuration of control for the apparatus in FIG. 1.

FIG. 4 is a block diagram illustrating the configuration of control for the inkjet printing apparatus 10. A ROM 4001 stores therein control programs to be executed and each set value in the control. A RAM 4002 performs development for executing the control program, storage of print data and control commands, and storage of a control variant in each control. A timer circuit 4003 is a circuit that can obtain the present time or measure an elapsed time. An involatile memory 4004 is a memory means that can store parameters stored in the control even in a state where a power source of the body is cut off, and performs the writing and reading of a time as a starting point at the time of calculating an elapsed time in the control of the present invention.

A control circuit 4000 executes the control program stored in the ROM 4001 or the control program developed in the RAM 4002. The sequence in the present invention is a part of the sequence executed in the control program. The time used in the execution of the sequence of the present invention is indicated by using the present time or the elapsed time obtained in the timer circuit 4003. An external connection circuit 4005 is an interface for communication between the inkjet printing apparatus body and an external host device by wire or wireless, and a circuit that enables the control circuit 4000 to deal with a control signal therebetween. Data of an image recorded outside is input to the inkjet printing apparatus body through the external connection circuit 4005. In addition, the present time may be input to the inkjet printing apparatus body through the external connection circuit 4005.

The control circuit 4000 develops the received image data on the RAM 4002. Further, the control circuit 4000 controls a drive of a print head unit 4007 through a print head unit drive circuit 4006 based upon data on the RAM 4002, and at the same time, controls a carriage motor 4011 through a carriage motor drive circuit 4010. Ejection of ink is performed in a desired position of the print medium by control of the control circuit 4000, resulting in execution of one print scan. In addition, the control circuit 4000 controls a conveyance motor 4013 through a conveyance motor drive circuit 4012 to convey the print medium by a desired amount.

In regard to the suction recovery in the sequence of the present invention, the control circuit 4000 controls a purge motor 4009 through a purge motor drive circuit 4008 to suck a desired ink amount by the print head. In addition, in regard to the ink ejection to the cap 23, the control circuit 4000 controls a drive of the print head unit 4007 through the print head unit drive circuit 4006 to eject a desired ink amount to the cap 23. In this case, a pattern for driving the print head is based upon any of data developed in the RAM 4002 as similar to the print operation, data in the ROM 4001 or data generated in the control circuit.

Figure 5:
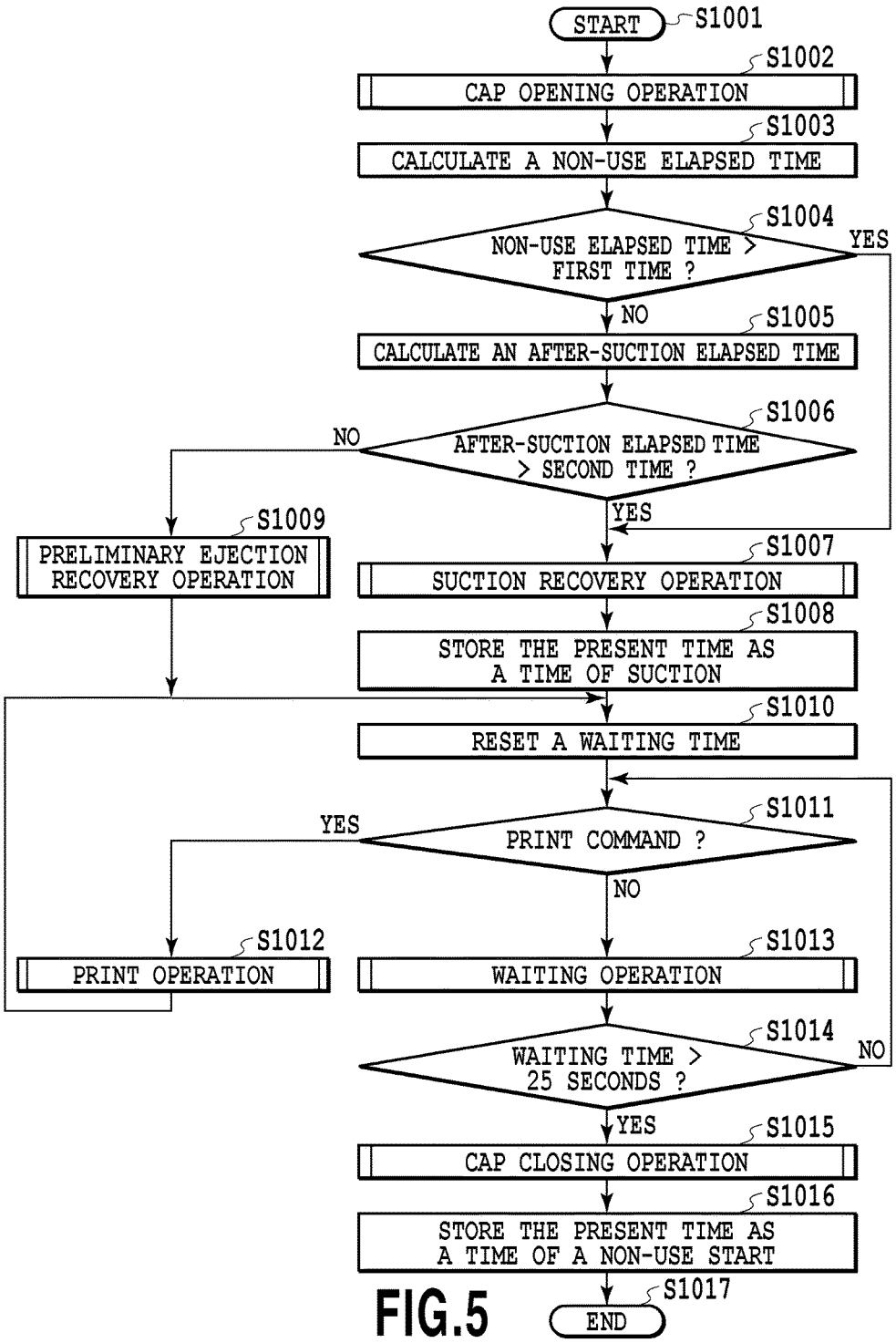
FIG. 5 is a flow chart illustrating the process from a cap opening operation to a cap closing operation in the apparatus in FIG. 1.

FIG. 5 is a flow chart illustrating a print process composed of a series of operations from a cap opening operation to a cap closed operation in the present embodiment. Hereinafter, an explanation will be made of the print process composed of the series of the operations in the present embodiment along this flow chart.

When the print head unit 100 is positioned on the purge unit 20 and receives a print command in a state where the print head 110 is left in a non-use state in a state of abutting on the cap 23, at step S1002 an operation of opening the cap 23 (separating it from the print head) is performed. However, this operation is not necessarily performed at this timing in this flow chart, but is performed at this timing because of a general operation.

It should be noted that the start of this process may be triggered by switching on the power source, by a print command or by a command preparing for a print. The print command herein is a command that is executed upon confirming that a button for starting a copy for copy function is pushed at reception of print data or the like.

Next, at step S1003 a non-use elapsed time equivalent to an elapsed time from completion of the previous printing is calculated (to obtain a first elapsed time). In the present embodiment, the non-use elapsed time is calculated by comparing the time at the cap closing operation completion after completion of the previous printing with the present time. Here, the present time may be obtained by providing the printing apparatus with a clock means, by sending the time from a host side sending print data, by the network or the like. It should be noted that the non-use elapsed time may be calculated by comparing the time at the cap closing operation completion after completion of the previous printing with the time at the cap opening operation completion thereafter.

Next, at step S1004 it is determined whether or not the non-use elapsed time (first elapsed time) calculated at step S1003 exceeds a predetermined first time. This first time is a period from a point where the print head is left without ejecting ink from the ejection port to a point where ink adheres to the ejection port due thereto, resulting in being not able to normally eject ink or to a point where the ink is ejected but an ink consumption amount until the ejection is normally performed becomes larger than an ink amount consumed by the sucking operation. It should be noted that the first time is determined by the structure of the print head, the capability of the printing apparatus body for preventing evaporation, the composition of ink, and environment conditions of temperature, humidity and the like at the non-use elapsed time. From the result of reviewing the first time, in regard to ink components, it is found out that it is necessary to set the first time to be shorter for ink of pigment than dye as a color material. It is estimated that this is because of transfer of the pigment ink from a state of being dispersed in the solution to a state of settling out therein following the time elapse or by acceleration of a transferring speed to the settling state following the evaporation of the solution.

In a case where at step S1004 it is determined that the non-use elapsed time is within the first time, the process goes to step S1005. At step S1005, the elapsed time from the previous suction recovery operation is calculated by comparing the time at completion of the previous suction recovery operation with the present time (to obtain the second elapsed time). It should be noted that the elapsed time from the previous suction recovery operation may be calculated by comparing the time at completion of the previous suction recovery operation with the time at completion of the cap opening operation at the cap opening after closing the cap thereafter. After that, at step S1006 it is determined whether or not the elapsed time (second elapsed time) from the previous suction recovery operation calculated at step S1005 exceeds a predetermined second time. The second time is a period in which an accumulation amount of air bubbles mixed in the flow passage for supplying ink from the ink tank 160 to the print head 110 exceeds the amount of ink that can be normally ejected. The air bubble is mixed in the flow passage through a member forming mainly the flow passage. In addition, the mixed air bubble closes the ink flow passage to block the supply of ink, resulting in preventing normal ejection of ink.

In a case where at step S1004 it is determined that the non-use elapsed time exceeds the first time or in a case where at step S1006 it is determined that the elapsed time after the suction recovery operation exceeds the second time, at step S1007 the suction recovery operation is performed. In the sucking operation at step S1007, the suction of a discharge amount sufficient for removing the ink having adhered and having become thickened in viscosity from the print head and also a discharge amount sufficient for removing the air bubble mixed in the ink supply flow passage is performed. The suction amount necessary for removal of the ink having adhered and having become thickened in viscosity is only required to be equal to the amount of an ink supply flow passage volume near the ejection port 200, but for the removal of the air bubble, the suction of the amount of ink equal to or more than the ink supply flow passage volume from the ink tank to the ejection port 200 is required.

Accordingly, the suction amount in the suction recovery operation at step S1007 is designed to be equal to the discharge amount sufficient for removing the air bubble in the latter. The process goes to step S1008 after completion of the suction recovery operation at step S1007. At step S1008 the present time is obtained, and the present time is stored as a time when the suction recovery is completed. In regard to the memory means, it is preferable to store the time in an involatile memory representative of an EEPROM. The reason for this is to assume a state where this control is performed on a condition that the print head is left in a non-use state for a certain time and therefore the power supply is cut off. From a point of view as described above, the present time may be first stored in the RAM, and then, in the involatile memory at the time of cutting off the power source.

In a case where at step S1006 it is determined that the elapsed time after the suction recovery operation is within the second time, at step S1009 a preliminary ejection recovery operation is performed. The ink ejection of the preliminary ejection recovery operation at step S1009 is ink ejection for recovery of an ejection state from the ejection port by ejecting ink outside of a sheet surface of a print medium. In the present invention, the ink ejection is performed for the ejection state to be recovered in the cap 23. In addition, the amount of ink discharged by the ink ejection at this time is determined by the non-use elapsed time calculated at step S1003.

The determining method may be a method using a function of calculating the number of ink ejections with the non-use elapsed time or a method of determining the number of ink ejections with a lookup table showing a relation between the non-use elapsed time and the number of ink ejections. The possible maximum value of the non-use elapsed time at step S1009 is the first time. The ink consumption amount at step S1009 in a case where the non-use elapsed time is the first time is an ink amount smaller than in the suction recovery operation at step S1007.

When the process at step S1008 or at step S1009 is completed, the process goes to step S1010, wherein the measurement of an elapsed time (hereinafter, called "waiting time") of a state of waiting for a print command to come in a non-capping state starts. The start of the measurement is to start the measurement from zero after resetting a timer of measuring the waiting time. Next, at step S1011 it is determined whether or not the print command is present. In a case where at step S1011 it is determined that the print command is present, the process goes to step S1012, wherein a series of image print operations are performed to complete an image on the print medium.

When the image is completed at step S1012, the process goes back to step S1010. In a case where at step S1011 it is determined that the print command is not present, at step S1013 the process enters the waiting state (waiting operation) of waiting for the print command. The waiting state at this time comprises the process of circulating between step S1013 including step S1011, and step S1014.

At step S1013 a necessary operation may be performed in the waiting state. In the present invention, an operation of preparing for the printing, which ejects ink to the cap 23 to prevent the viscosity thickening and adhesion of ink in the ejection port, is performed as needed. At step S1014 it is determined whether or not the waiting time exceeds 25 seconds. In a case where the waiting time exceeds 25 seconds, it is determined that the print command does not come for the time being, and the process goes to the non-use state. Here, in the present embodiment, the maximum length of the waiting time is set to 25 seconds, but may be set to a predetermined time other than 25 seconds. First at step S1015 a series of operations are performed to close the cap.

The series of operations comprise a wiping operation of wiping the ejection port face of the print head with a wiper, an ejection operation of removing the viscosity thickened ink pressed into the ejection port by the wiping operation, a pump rotating operation of discharging the ink reserved in the cap, and a capping operation of causing the cap to abut on the print head. Next, at step S1016 the present time is obtained, which is stored as the time when the non-use elapsed time starts. When these operations are completed, the print process composed of the series of the print operations ends.

It should be noted that the ink used in the present embodiment is an ink including color materials having pigments of all colors, and the first time is set to 360 hours (15 days) and the second time is set to 648 hours (27 days).

According to the present sequence, two times composed of the non-use elapsed time and the after-suction elapsed time are managed, and the necessity of the recovery operation is determined by comparing each thereof with the first time and the second time.

In the calculation of the non-use elapsed time at step S1003, a predetermined time from the print operation completion at step S1012 to the cap closing operation at step S1015 may be preliminarily estimated, which adds to the non-use elapsed time.

The processes of step S1007 and step S1009 may be recovery operations different in a recovery level. That is, it is permitted only if the recovery level in the recovery process at step S1007 is higher than the recovery level in the recovery process at step S1009. For example, the recovery process of step S1009 as well as the recovery process step S1007 may be performed as preliminary ejection recovery operations, wherein the preliminary ejection recovery operation at step S1007 may be set as the process of performing more preliminary ejections than the preliminary ejection recovery operation at step S1009.

In this way, the recovery operation is performed considering both of the elapsed time of the non-use state where the printing is not performed and the elapsed time from the previous sucking operation. As a result, it is possible to realize the inkjet printing apparatus that can execute the recovery process appropriate for the print head according to the use condition of the inkjet printing apparatus.

Second Embodiment

Hereinafter, an explanation will be made of a second embodiment in the present invention with respect to the accompanying drawings. Since a basic configuration of the present embodiment is similar to that of the first embodiment, only a characteristic configuration of the present embodiment will be hereinafter explained.

Figures 6, 6A:
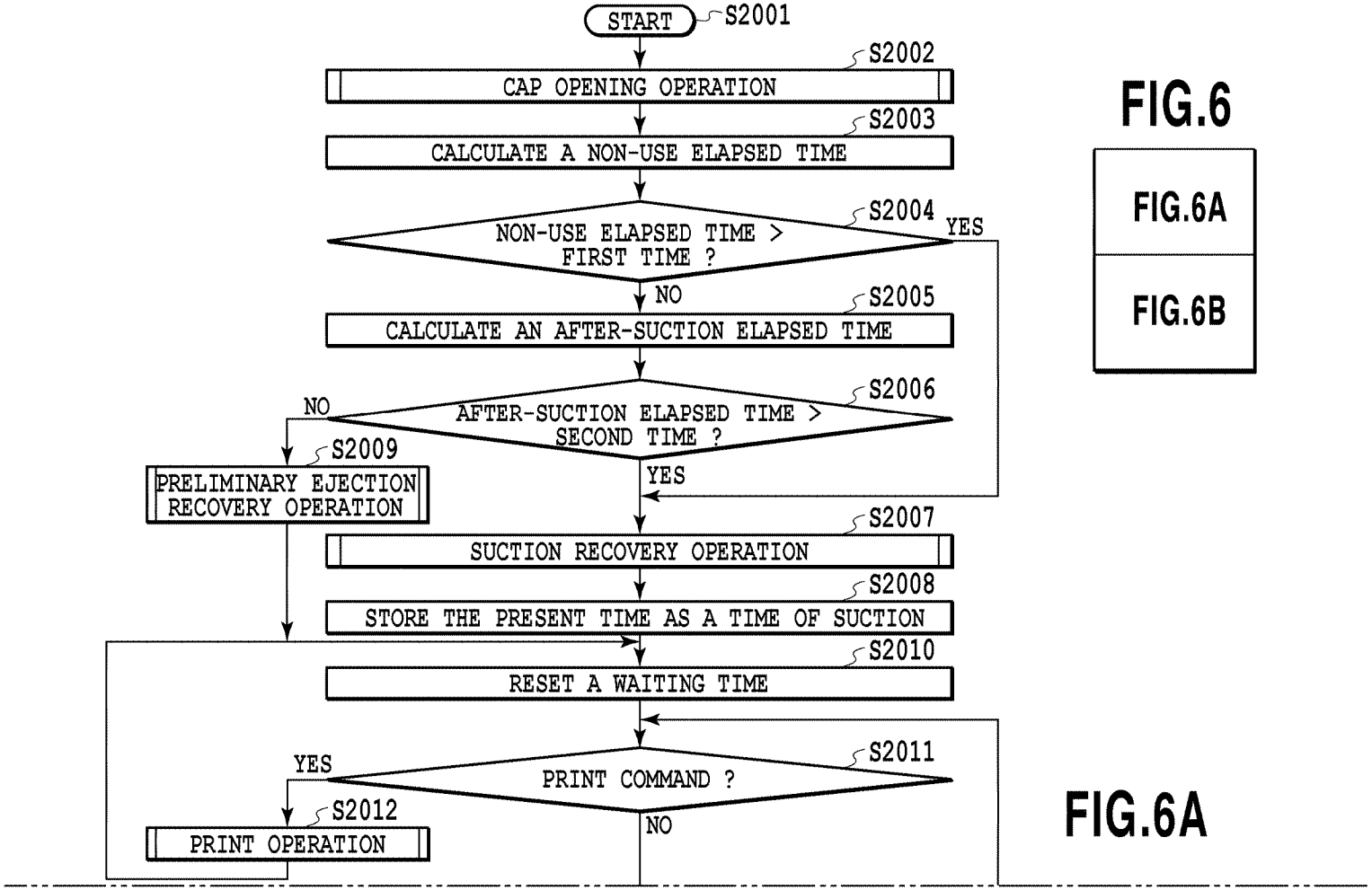
FIG. 6 is a diagram showing the relationship between FIGS. 6A and 6B.
FIGS. 6A and 6B are a flow chart illustrating the process from a cap opening operation to a cap closing operation in the apparatus in FIG. 1.
Figure 6B:
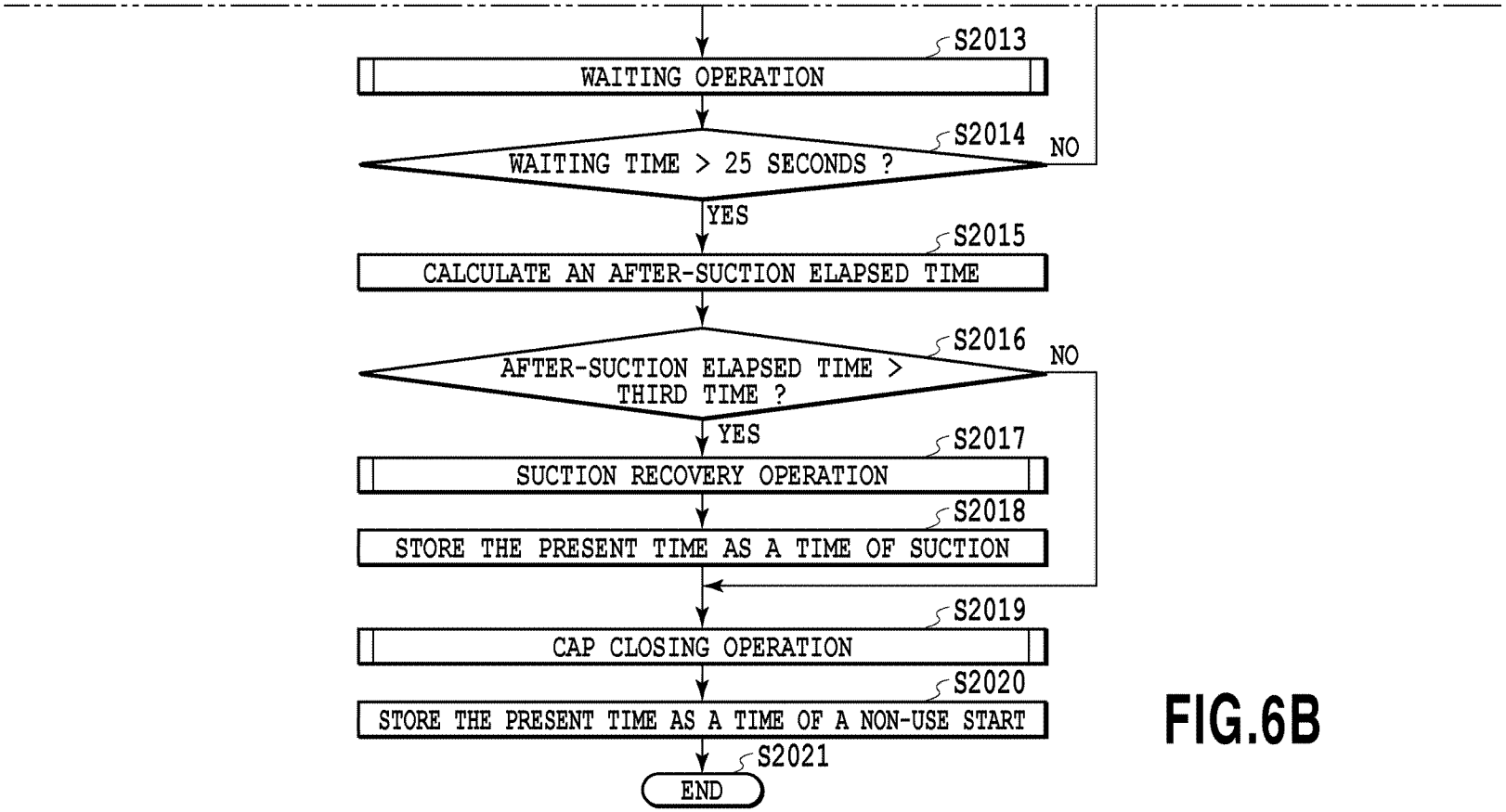
Figure 7B:
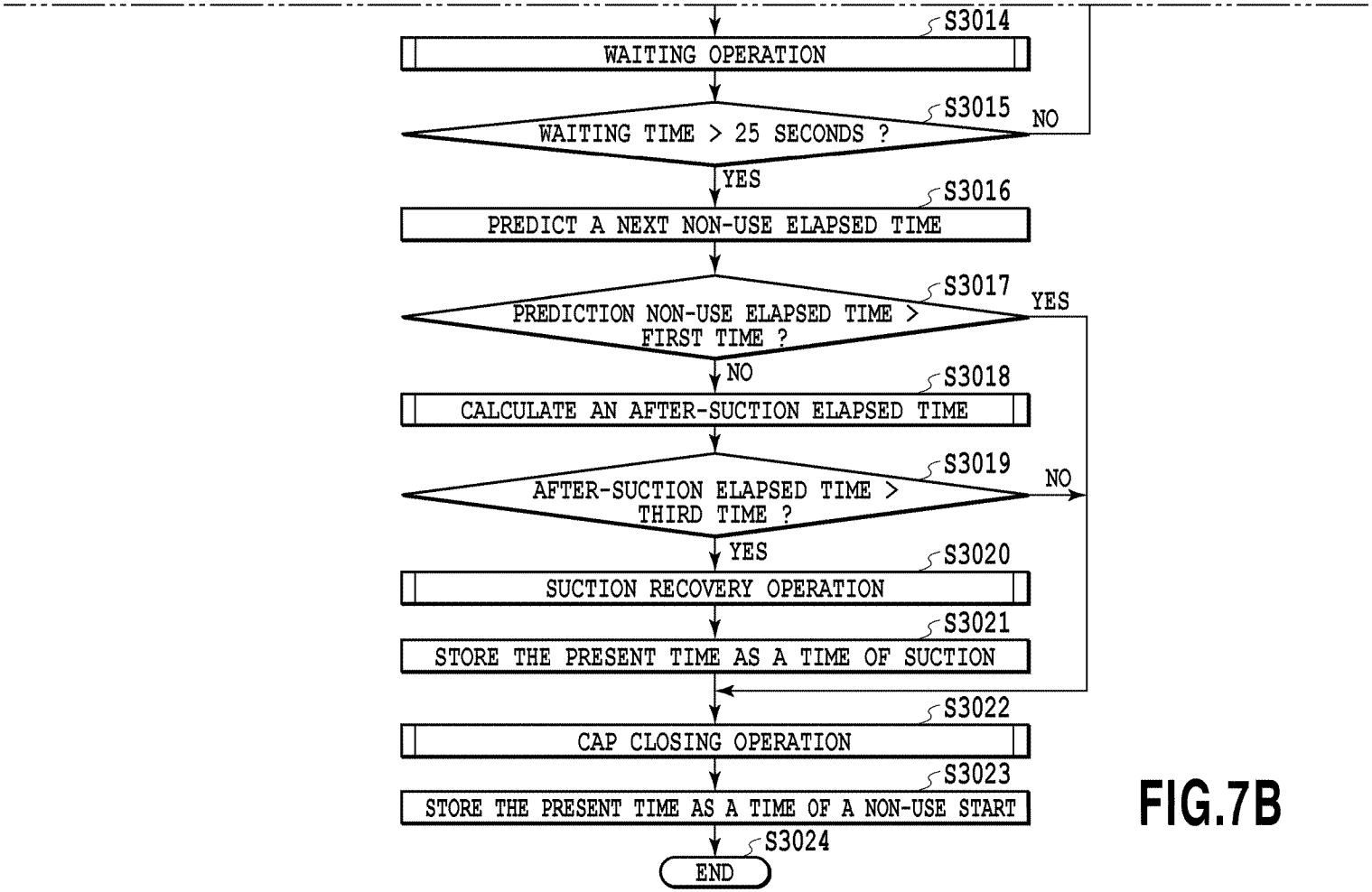

FIGS. 6A and 6B are a flowchart illustrating a print process composed of a series of operations from a cap opening operation to a cap closing operation in the present embodiment. Hereinafter, an explanation will be made of the print process composed of the series of the operations along this flow chart. In the process of the present embodiment, the suction recovery operation executed before the print operation can be reduced more than in the process of the first embodiment.

It should be noted that since the control flow from the step S2002 to step S2014 is the same as that from step S1002 to step S1014 in the first embodiment, the explanation is omitted.

In a case where at step S2014 it is determined that the waiting time exceeds 25 seconds as a predetermined time, it is determined that the print command does not come for the time being, and the process goes to the non-use state, wherein the processes from step S2015 to step S2021 are executed. First, at step S2015, as similar to the process at step S2005, the elapsed time from the previous suction recovery operation is calculated by comparing the time at completion of the previous suction recovery operation with the present time. Next, at step S2016 it is determined whether or not the elapsed time after the suction recovery operation exceeds a predetermined third time. Here, the third time is set to a time shorter than the second time. In a case where at step S2016 it is determined that the elapsed time after the suction recovery operation exceeds the third time, at step S2017 a suction recovery operation similar to the process at step S2007 is performed.

This suction recovery operation is performed by estimating that the second time elapses from the previous recovery operation at the next non-use elapsed time by the determination at step S2016, and the time until the print start after being left in a non-use state can be shortened by performing the suction recovery operation herein. After the suction recovery operation is performed at step S2017, at step S2018 the present time is obtained as similar to the process at step S2008, and this time is stored as a time when the suction recovery is performed. In a case where at step S2016 it is determined that the elapsed time after the suction recovery operation is within the third time, the process goes to the non-use state, wherein processes at step S2019, step S2020 and step S2021 are executed. Since the processes at step S2019, step S2020 and step S2021 are the same as those at step S1015, step S1016 and step S1017 in the first embodiment, the explanation thereof is omitted.

In the present embodiment, as similar to the first embodiment, the first time is set to 360 hours (15 days), and the second time is set to 648 hours (27 days). Here, the third time is set to 576 hours (24 days) shorter than the second time.

By setting the third time to be shorter than the second time in this way, in a case where the print head is used quite frequently, there is no possibility that the sucking operation is performed before the print operation, and a user is not forced to wait for the output long. In addition, performing the suction recovery operation at the timing of transferring to the non-use state enables an event that a user feels relatively inconvenient to be reduced. Further, performing the suction recovery operation at the timing of transferring to the non-use state enables air bubbles supposed to be mixed into the flow passage to supply ink after the next non-use state to be discharged and shortens the time until the print start after being left in a non-use state.

In this way, the present embodiment makes use of the finding that the necessity of the suction recovery occurring before printing is managed with two kinds of elapsed times based upon the respective causes, thus making it possible to determine the necessity to some extent even after the printing.

Third Embodiment

Hereinafter, an explanation will be made of a third embodiment in the present invention with respect to the accompanying drawings. Since a basic configuration of the present embodiment is similar to that of the first embodiment, only a characteristic configuration of the present embodiment will be hereinafter explained.

In the second embodiment, the suction recovery operation is performed at the timing of transferring to the non-use state using the third time. If the non-use state period after the suction recovery operation is equal to or more than the first time, the suction recovery operation performed at the timing of transferring to the non-use state results in wasteful suction. That is, this is because if the non-use state period is equal to or more than the first time, the suction recovery operation is necessarily performed before the print process. Therefore in the present embodiment, sequences that will be described as follows add to the sequences shown from step S2001 to step S2021 to reduce the wasteful sucking operation.

A first sequence that adds thereto is step S3004. In this sequence, the non-use elapsed time calculated as similar to step S2003 in the second embodiment at step S3003 is stored in an involatile memory as a history. The next sequence that adds thereto is composed of step S3016, step S3017 and step S3018. This sequence is a sequence that is executed at the time of transferring to the non-use state by determining that the print command does not come for the time being in a case where it is determined that the waiting time exceeds 25 seconds as a predetermined time at step S3015. First, at step S3016 a period from an average value of the non-use periods left in the history to the next use start is predicted as a prediction non-use elapsed time based upon the history of the non-use elapsed time stored at step S3004. Next, at step S3017 it is determined whether or not the predicted non-use elapsed time (prediction non-use elapsed time) exceeds the first time.

In a case where at step 3017 it is determined that the non-use elapsed time predicted at step S3016 exceeds the first time, the processes of step S3022, step S3023 and step S3024 are executed to transfer to the non-use state. This determination is to determine whether or not it is wasteful to perform the suction recovery operation at this point. That is, this is because in a case where the prediction non-use elapsed time exceeds the first time, since the suction recovery operation is performed in the sequence from step S3005 after the non-use elapsed time, even if the suction recovery operation is preliminarily performed before cap closing, it becomes wasteful. It should be noted that the average value is used in one method of predicting the period until the next use start, but, not limited thereto, a central value or the like may be used.

In a case where at step S3017 it is determined that the predicted non-use elapsed time is within the first time, step S3019, step S3010 and step S3012 as the sequence similar to the sequence from step S2016 to step S2018 in the second embodiment are executed. In this process, the recovery due to the thickened viscosity and adhesion of ink in the ejection port by the next non-use state can be achieved by the preliminary ejection recovery operation at step S3010, and with the determination at step S3017, the necessity of the suction performed for removing bubbles in the ink supply flow passage is only required to be determined.

According to the present embodiment, the printing apparatus body learns use conditions by the use history, predicts the non-use elapse period and narrows the case of being able to effectively avoid the suction before printing, thus making it possible to perform the suction recovery operation before transferring to the non-use state after the cap closing. Therefore it is possible to shorten the time until the print start after being left in a non-use state while preventing the suction recovery operation from being wastefully performed. In the present embodiment, managing two kinds of elapsed times enables the prediction control to be incorporated with accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170345, filed Aug. 25, 2014, which is hereby incorporated by reference wherein in its entirety.

What is claimed is:

1. An inkjet printing apparatus comprising:

a print head that ejects ink from an ejection port to perform a print operation, the print head having an ejection port surface on which the ejection port is formed;

a sucking unit having a cap which contacts the ejection port surface to perform a sucking operation of sucking the ink from the ejection port;

a first obtaining unit that obtains a first elapsed time from the end of a previous print operation;

a second obtaining unit that obtains a second elapsed time from a previous sucking operation by the sucking unit; and a control unit that causes the sucking unit to perform the sucking operation in at least one of (i) a case where the first elapsed time is longer than a first threshold time and (ii) a case where the second elapsed time is longer than a second threshold time, the second threshold time being longer than the first threshold time, wherein if the second elapsed time is longer than a third elapsed time which is shorter than the second threshold time after performing the print operation, the control unit causes the sucking unit to perform the sucking operation.

2. The inkjet printing apparatus according to claim 1, wherein, in a case where the second elapsed time is not longer than the second threshold time, the control unit causes the print head to perform a preliminary ejection operation, in which ink is ejected from the ejection port for recovery of an ejection state of the print head, before performing a print operation.

3. The inkjet printing apparatus according to claim 1, further comprising:

a memory unit that stores the first elapsed time as a history; and a predicting unit that predicts a non-use elapse time until a next print operation based upon the history of the first elapsed time stored in the memory unit.

4. The inkjet printing apparatus according to claim 3, wherein, when the non-use elapse time predicted by the predicting unit is longer than the first threshold time, and the length of a waiting state of the print head exceeds a predetermined time, the control unit completes the waiting state without performing the sucking operation.

5. The inkjet printing apparatus according to claim 4, wherein the predicting unit predicts the non-use elapse time from an average value in the history of the first elapsed time stored by the memory unit.

6. A recovery method of a print head comprising:

a printing step for ejecting ink from an ejection port of a print head to perform a print operation, the print head having an ejection port surface on which the ejection port is formed;

a sucking step for contacting a cap with the ejection port surface to perform a sucking operation of sucking the ink from the ejection port of the print head;

a first time obtaining step for obtaining a first elapsed time from the end of a previous print operation; and a second obtaining step for obtaining a second elapsed time from a previous sucking operation in the sucking step, wherein, the sucking operation in the sucking step is performed in at least one of (i) a case where the first elapsed time is longer than a first threshold time and (ii) a case where the second elapsed time is longer than a second threshold time, the second threshold time being longer than the first threshold time, and wherein if the second elapsed time is longer than a third elapsed time which is shorter than the second threshold time after performing the print operation, the sucking operation in the sucking step is performed.

* * * * *